US005711097A

United States Patent [19]

Minó

[11] Patent Number: 5,711,097

[45] Date of Patent: Jan. 27, 1998

[54] PRESS FOR THE AUTOMATIC IRONING AND FINISHING OF THE TROUSERS

[76] Inventor: Antonio Minó, Via Ravalli 21, San Nicandro Garganico, Italy

[21] Appl. No.: 686,769

[22] Filed: Jul. 26, 1996

[30] Foreign Application Priority Data

Aug. 1, 1995 [IT] Italy ..... FE695A003

[51] Int. Cl.[6] ..... D06F 71/29

[52] U.S. Cl. ..... 38/21; 223/73

[58] Field of Search ..... 38/21, 70, 71, 38/69, 23, 20, 12, 66, 16; 223/63, 72, 73, 52

[56] References Cited

U.S. PATENT DOCUMENTS

| | | | |
|---|---|---|---|
| 2,529,899 | 11/1950 | Bayler | 38/21 |
| 2,627,128 | 2/1953 | Jones | 38/21 |
| 3,835,559 | 9/1974 | Kotter | 38/21 |
| 4,473,961 | 10/1984 | Frushtick | 38/42 |

FOREIGN PATENT DOCUMENTS

| | | | |
|---|---|---|---|
| 2402027 | 4/1979 | France | 38/21 |
| 2307635 | 8/1974 | Germany . | |

*Primary Examiner*—Ismael Izaguirre

*Attorney, Agent, or Firm*—Beveridge, DeGrandi, Weilacher & Young, L.L.P.

[57] ABSTRACT

This invention concerns a press for ironing trousers consisting of a triplet of vertical panels between which both the legs and the pelvis of the trousers are ironed, the latter being held open by a series of inflatable slabs and shapes supported by relevant carriages sliding horizontally and vertically with respect to the supporting and guide scaffolding positioned above the triplet of panels.

14 Claims, 5 Drawing Sheets

PRESS FOR THE AUTOMATIC IRONING AND FINISHING OF THE TROUSERS

BACKGROUND AND SUMMARY OF THE INVENTION

The present invention has as an object to provide a press for the automatic ironing and finishing of trousers.

The present invention represents a brand new automatic-press machine in the field of the ironing machines, because there does not exist in the current market a machine that can iron trousers automatically. And more precisely, the types of ironing machines presently on the market in this field can only iron the legs of a pair of trousers. They can not iron the full side of a pair of trousers, namely, the waist, the pelvis, the pockets and the crotch.

Usually the ironing of the side of a pair of trousers which is closer to the waist has to be done manually or with the use of special equipment called ironing-pelvis-machines.

In any case, the ironing of the pelvis of a pair of trousers is always done separately from the legs, because until today a press has not been built that can operate and iron simultaneously both sides, the pelvis and the legs of a pair of trousers, so that the complete ironing of the trousers can be done with only one phase operation ironing.

The purpose of this invention is to build a press that can iron simultaneously both the legs and the waist portion of a pair of trousers.

Thus, according to one embodiment, the present invention is comprised substantially by three panels of ironing members, a central panel and two sideways panels that can tighten with a lock like the closure of a book against opposite faces of the central panel. The central panel has a reduced height in comparison to the two sideways panels.

The present invention includes also a scaffolding set on top of the three panels which is placed to support a series of mobile elements which insert into the pelvis of the trousers. The mobile elements hold the trousers in a position slightly open and with the folds stretched, during closure and ironing from the two sideways panels.

The above mobile series of elements contains two sideways pairs of patterns that can automatically get to the middle point in the folds of the pelvis of the trousers.

At the same time, the pelvis will be held open by inflated cushions of the external plates used to support the above mentioned external shapes.

On the bases of the scaffolding are three hooks, of which two are fixed and placed side by side a short distance apart, and one which is mobile, intermediate to the other two. The third hook is mobile and is supported by a flowing stem in a horizontal position, and is continually subject to the pressure of a spring that stretches to advance beyond the pairs of the two fixed hooks.

A fourth rear hook, lined up and facing the mobile hook of the above mentioned group of three hooks also is provided; this fourth rear hook is retractable and moved by a pneumatic piston with a horizontal axle.

As a matter of fact, the front triplet of the hooks and the fourth rear hook are placed to cooperate together to support the trousers when ironing such that the pelvis is placed in tension by the retractable rear hook. Then, the waist of the trousers is placed against the two hooks of the front triplet. And more precisely, the two fixed front hooks are inserted inside the waist to match the front folds of the trousers, while the mobile front hook engages the outside of the waist at a middle point, which usually corresponds with the front flap of the trousers. Once the waist of the trousers has been hooked up by the hooks, the legs of the trousers must be put on the middle panel so that the legs are interposed, from the opposite parts, between the middle panel and the two side panels.

At this point, the two sideways pairs of patterns are put down and opened inside of the pelvis of the trousers, so that the two front and rear folds shall be spread.

The inflatable cushions applied to the rear patterns will then be inflated so that the pelvis shall be opened.

On the upper edge of the middle panel, two padded slabs are disposed, one in the front side and one in the rear side, to adapt respectively to the wedge between the front and rear folds of the pelvis to fill in the emptiness that there is between the folds.

Once the trousers have been prepared to be ironed, only a command needs to be given to lock the sideways panels. The side will close the legs of the trousers against the middle panel, while up to the higher side they will close the pelvis of the trousers both, against the pairs of the slabs as previously inflated, placed against the outside of the pelvis, and against the four patterns that have been threaded in to the inside of the pelvis.

In order for the triplet of panels to achieve vaporizing and aspiring, they should be able to distribute steam or to drain aria through those surfaces of the three panels that will come in to a reciprocal contact.

The front and rear padded slabs, will only be steamed.

BRIEF DESCRIPTION OF THE DRAWINGS

To more clearly and to better explain the press according to the present invention, the following description follows with reference to the attached Figures. Described herein, however, is only an example which is not, of course, to be interpreted in any way as being restrictive.

DETAILED DESCRIPTION OF THE INVENTION

Figure 1:
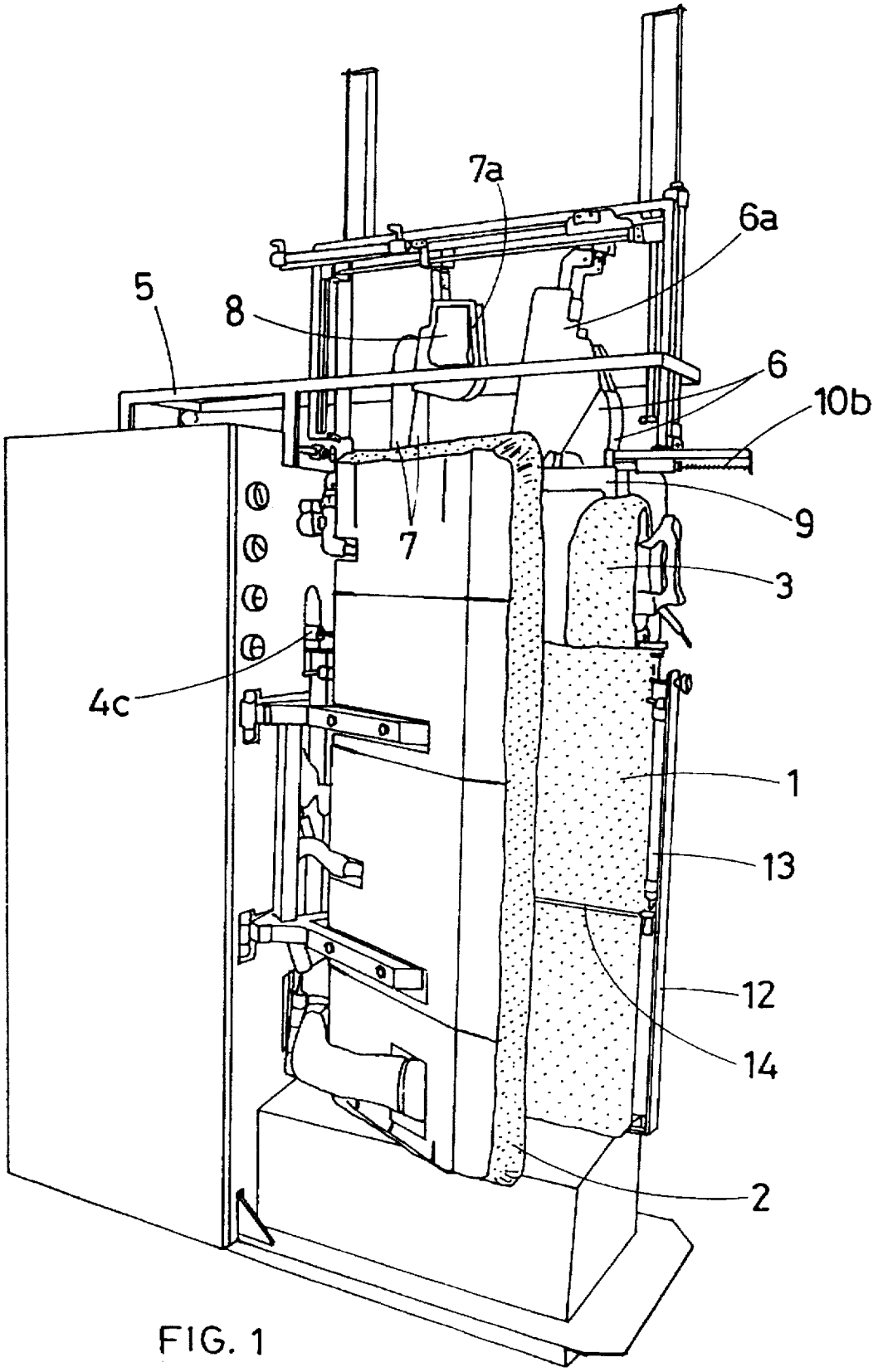
FIG. 1 shows a perspective representation of the press.

With reference to the Figs., the press includes a triplet of upright panels, of which one (1) is fixed and centered between two mobile panels. (2) Panels more precisely, the two mobile panels (2) are pivotable about an upright axle, so that it can open and close simultaneously like a book, closing about the middle panel (1).

The middle panel (1) has a height reduced in respect to the mobile panels (2). The mobile panels are moveable by a way of an automatic piston.

The press includes also two slabs molded and inflated, placed right on the top side (1*a*) of the middle panel (1).

The front inflated slab (3) is adjusted by a handle with a front grip (3*a*) which is of an arm of sustain member (3*b*) that can be slidably disposed inside a horizontal tubular lever (1*b*), hidden inside the panel (1), aligned with the top side (1*a*).

The rear inflated slab (4) has upright pivoted set (4*a*) and also is equipped with a lower arm as a support (4*b*) that can be slidably disposed inside the above mentioned horizontal tubular lever (1*b*) hidden inside the panel (1).

The pivoted set (4*a*) is employed to get in to the middle from the rear into inside the crotch of the trousers.

The front inflated slab (3) is manually removed, while the rear inflated slab (3) is manually removed, while the rear inflated slab (4) advances and retracts through a pneumatic piston (4*c*).

The pivoted set (4*a*) of the rear inflated slab (4) determines the automatic stopping of the advancement of the slab (4).

During the advancement of the inflated slab (4), in fact, its pivoted set (4*a*) is subject to a gradual turning over to the back as it will increase its degree to wedge on the rear of the crotch of the trousers.

When the above said pivoted set (4*a*) reaches its maximum angle of turning over to the back, a switch is activated which disarms the piston (4*c*) of the rear slab (4). The press includes also a scaffolding (5) placed over the middle panel (1). The scaffolding (5) supports a series of mobile elements designed to be threaded inside the pelvis of the trousers, so that the pelvis of the trousers is maintained in a position slightly spread and with its folds stretched during the closing of the two mobile panels (2). These mobile elements are in fact able to move in horizontal and upright ways, switched from both pneumatic pistons, so that they can be let down into the waist of the trousers and both spread, so to maintain the waist of the trouser in a position slightly opened and with its folds stretched during closing of the two mobile panels (2).

Figure 2:
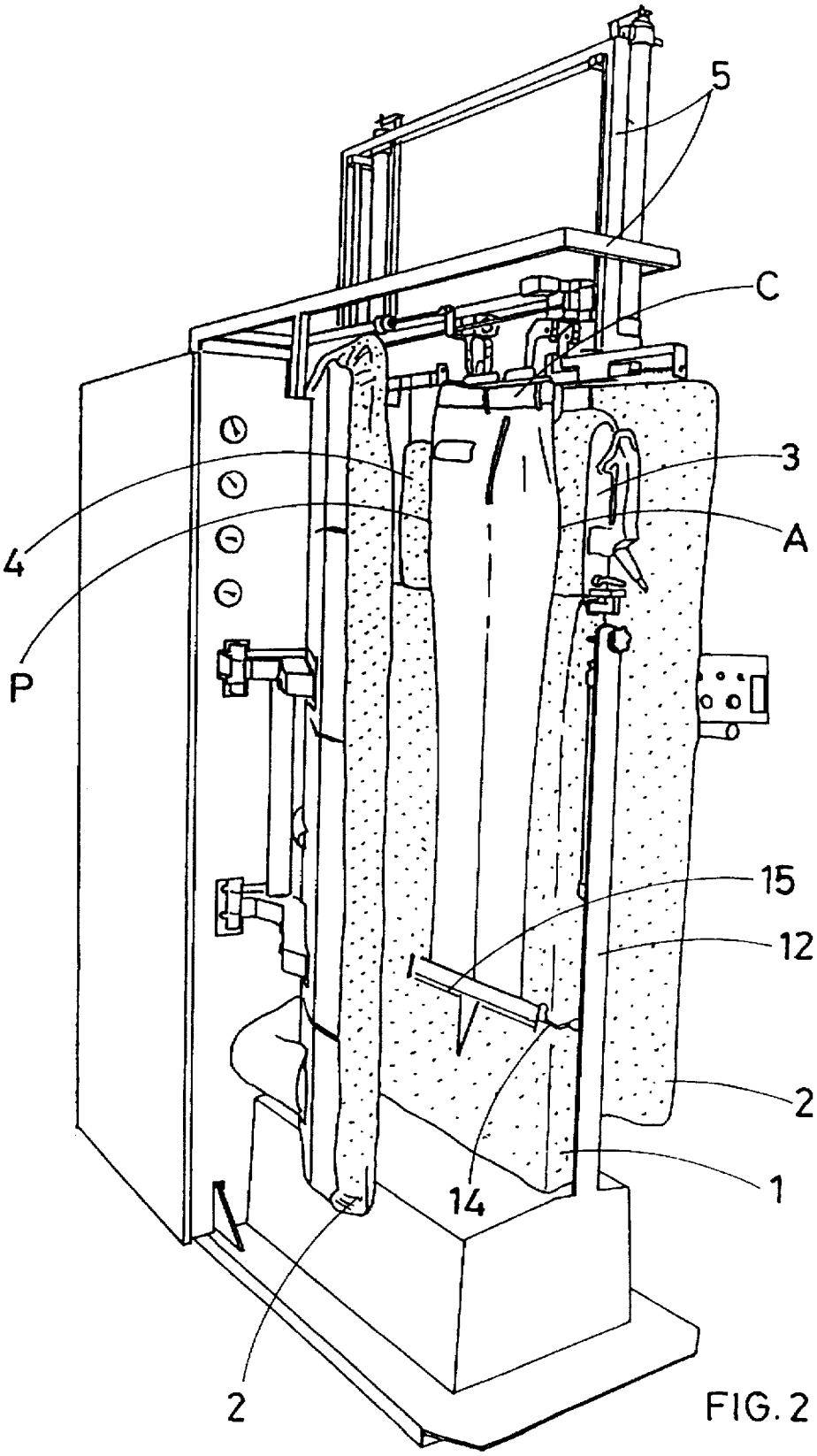
FIG. 2 shows a perspective representation of the press opened and loaded with a pair of trousers ready to be ironed.
Figure 3:
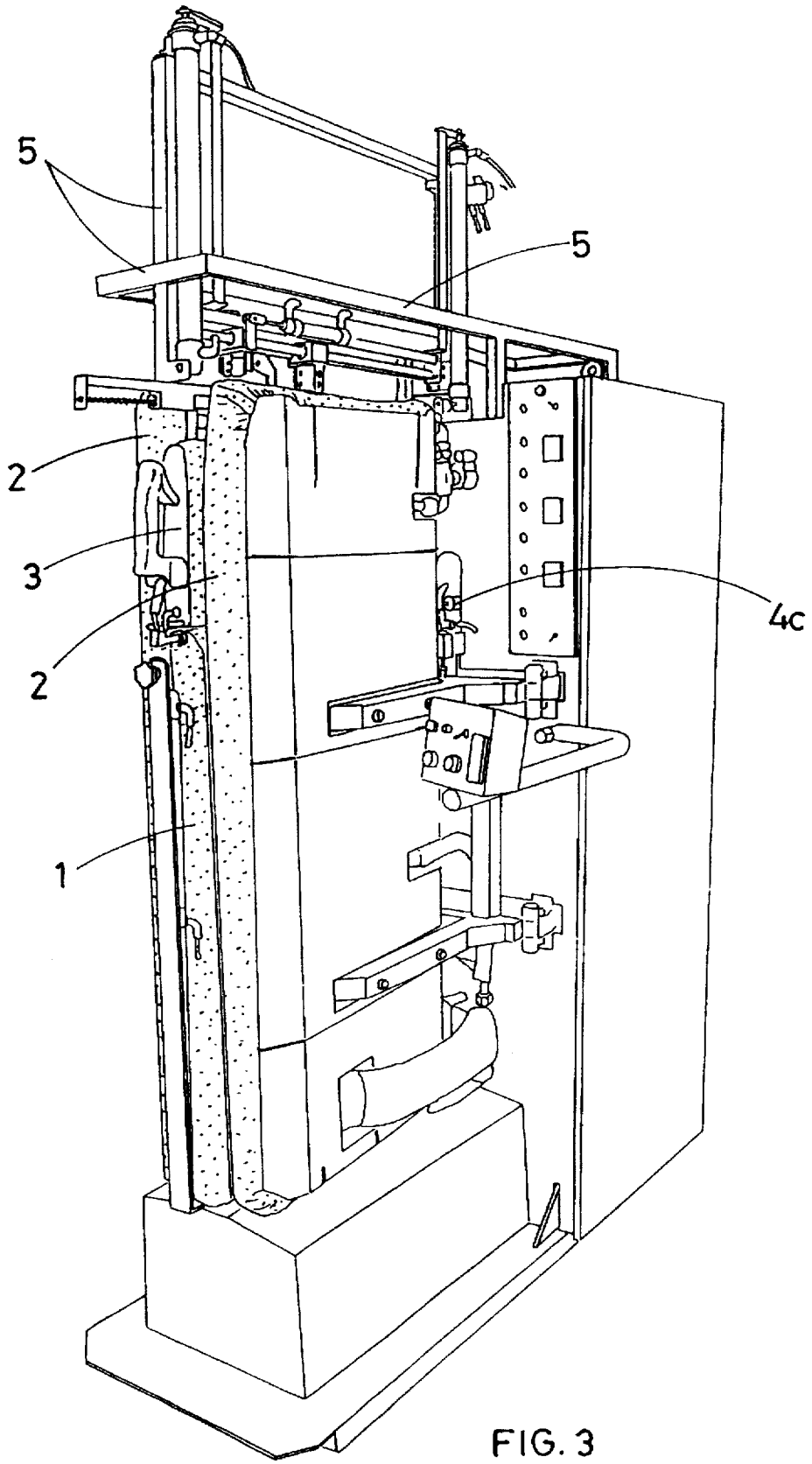
FIG. 3 shows a perspective representation of the press closed and in a position of ironing.
Figure 4:
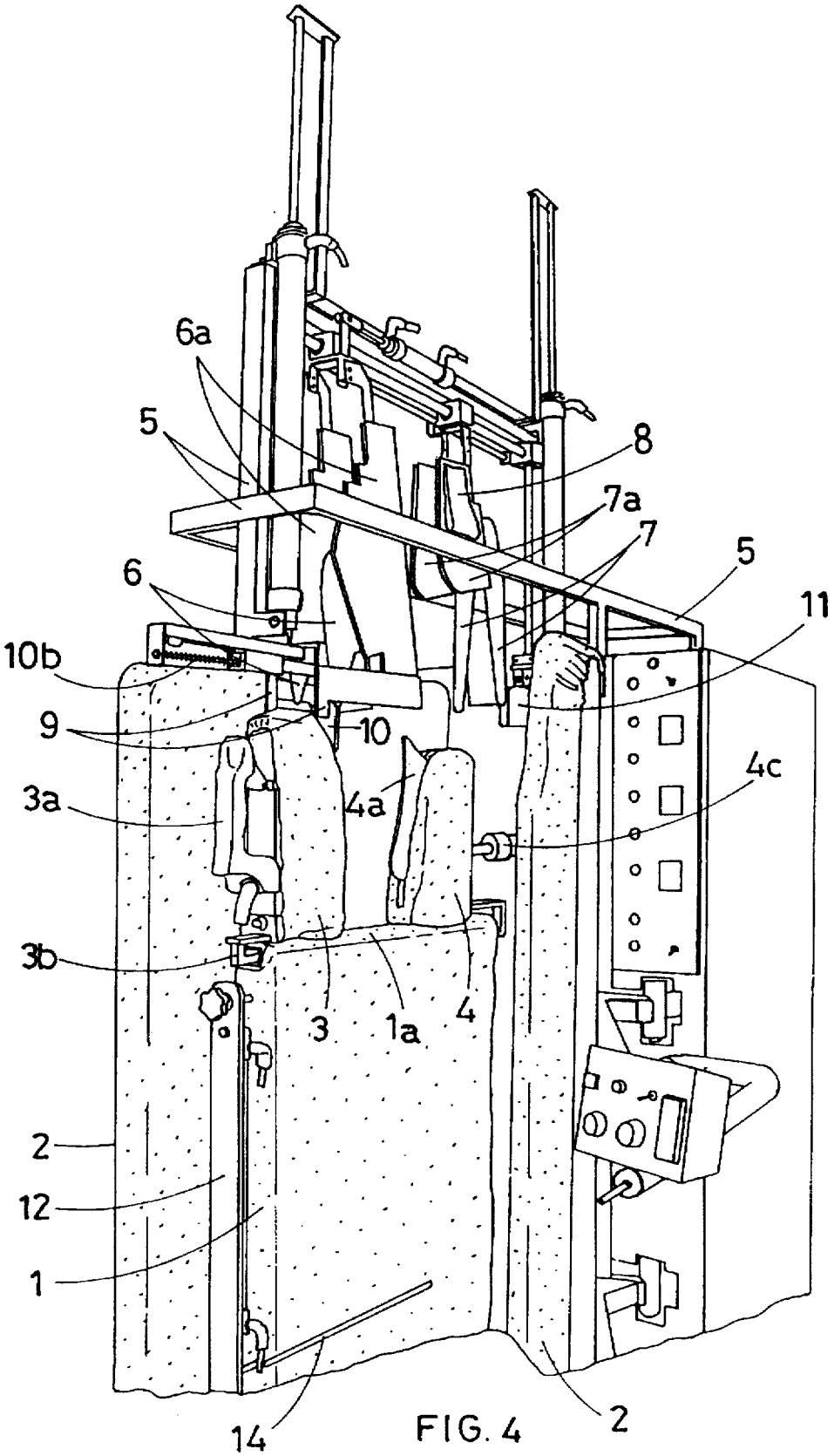
FIG. 4 shows a perspective representation of the upper end of the press.
Figure 5:
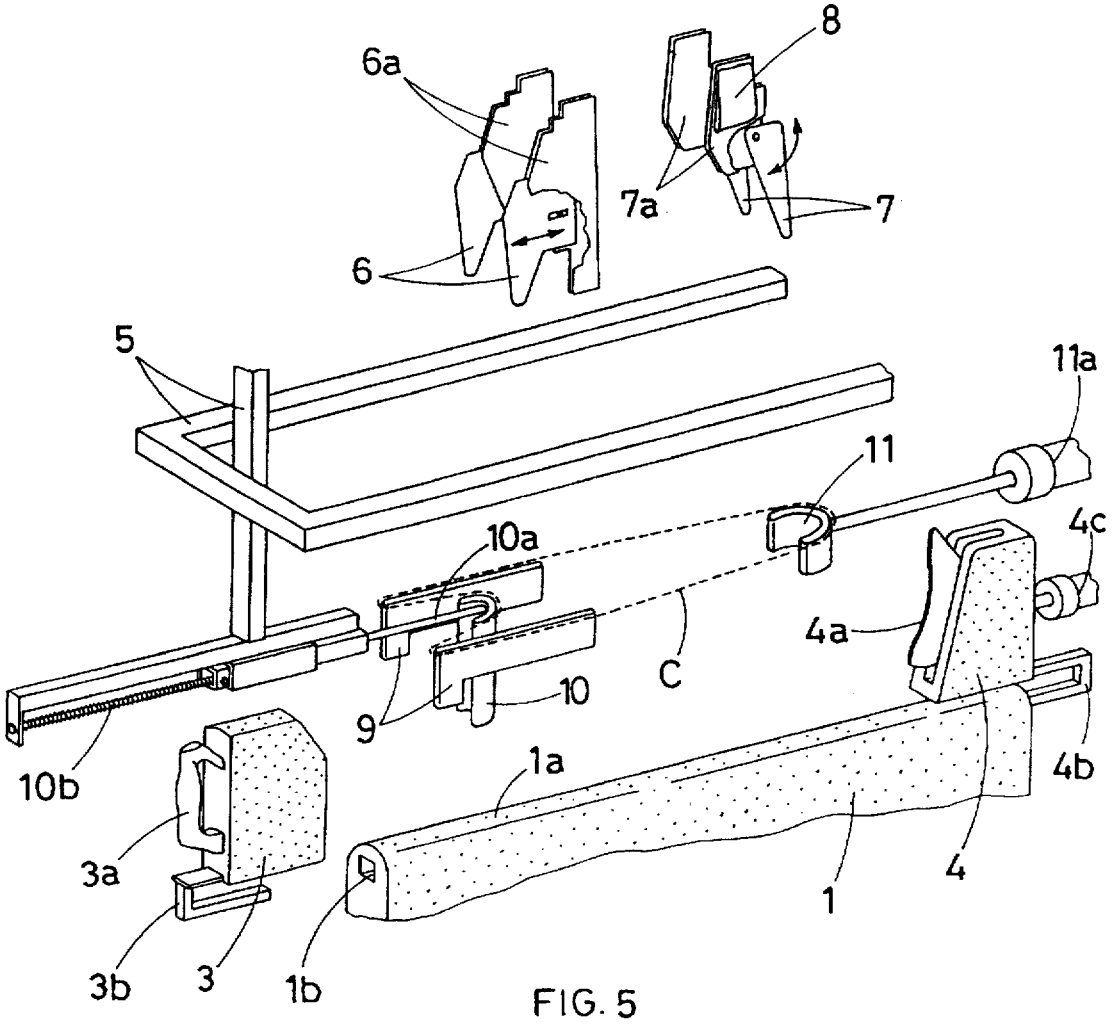
FIG. 5 shows in an exploded view, the various means provided to hook the waist of the trousers and to stretch out the folds of the trousers.

The series of mobile elements are made up of two sideways couples of upright shape, each one is made up from a front shaped member (6) and from a rear shaped member (7), which, once they have been let down into inside the waist (C) of the trousers and then spread, they automatically get in to the middle inside the front folds (A) and the rear folds (P) of the pelvis, respectively, as is most clearly shown in FIG. 2.

The shaped members (6 and 7) are supported by slabs (6*a* and 7*a*), working along horizontal tracks, being part of a carriage that is working in an upright position in respect to the supporting scaffolding (5). The front shaped members (6) are retractable in respect to the slabs (6*a*), being foreseen a matching of the type of prismatic between the slabs (6*a*) and the shapes (6), which are subject continuously to an expulsive pressure from a spring interposed between the slabs (6*a*) and the shapes (6).

The rear shapes (7) are pivoted in respect to the slabs (7*a*) being foreseen a matching of the type that it turn around between the slabs (7*a*) and the shaped members (7). The shaped members 7 are subject to a continuously expulsive pressure from a spring interposed between the slabs (7*a*) and the shaped members (7).

As a result of the springs (which can not been seen in the illustrations), the shaped members (6 and 7) are continuously pushed against the cloth of the trousers, so that shaped members (6 and 7) can automatically be set and automatically be centered inside the folds (A and P) of the trousers, keeping them spread during the ironing phase.

On the external face of the rear slabs (7*a*) inflatable cushions (8) which spread the pelvis of the trousers while the shaped members (6 and 7) spread the folds are disposed. On the base of the scaffolding (5) a front triplet of hooks and a fourth rear hook are disposed.

The triplet of the front hooks is made up of two fixed hooks (9) spatially arranged such that the front inflated slab (3) is disposed therebetween. The third hook (10), intermediate to the first two hooks, is supported from a horizontal working shaft (10*a*) which is continuously subject to the pressure of a spring (10*b*) that advances the third hook (10) into the inside and away from the two fixed hooks (9). The waist of the trousers will go between these three hooks such that the two fixed hooks (9) are engaging the inside of the waist in the proximity of the front folds (A) of the trousers, while the mobile middle hook (10) engages the outside of the waist in a middle point of the trousers.

To put the waist of the trousers in a taught position a fourth rear hook (11) must be used in addition to front triplet of hooks (9 and 10). The rear hook (11) is lined up and opposed to the front middle hook (10). The fourth hook (11) is retractable and is operated by a pneumatic piston (11*a*).

This hook (11) is put into the inside of the waist (C) in proximity of the middle point of the waist itself. The waist of the trousers will be put in tension by the retraction of the hook (11).

On the front side of the middle panel (1) a mobile staff (12) is placed to support a pneumatic piston (13). The pneumatic piston (13) is operable in upright reciprocating runs to displace a horizontal fork (14) which has clutches extending on the two opposed faces of the middle panel (1).

The fork (14) is for attaching to the legs of the trousers and spreading them on the two opposed faces of the middle panel (1). To obtain this result, two pliers (15) are provided on either side of the middle panel (1) to attach to the bottom of the two legs of the trousers. The pliers (15) have an internal (inside) button protuberant, that it can automatically be hooked from the clutches of the fork (14) when the fork runs through the lower side of the trousers.

The cycle of the automatic ironing will begin with the use and control of a small central switchboard with a control program providing the function of the press. The control starts after the operator has manually suspended the trousers to the hooks and after the front inflated slab (3) has been put into position. On the central panel (1), the control button is then pushed to start the cycle of ironing the trousers. In the Figs. it is to be noted that all the perforated surfaces allow for distribution of steam or inhale aria. The triplet of panels (1 and 2) are steamed and inhaled, in a sense that it can distribute steam or inhale aria through those surfaces of the three panels that are in mutual contact. The inflated slabs (3 and 4) are only steamed.

That means, that, the press is equipped with a system of production of water steam, as well as, it is equipped with a system of inhaling aria.

These systems, however, are not described or illustrated because conventional ones can be suitably used.

The pipes of the system for steaming and inhaling will reach the inside of the panels (1 and 2), while the inflated slabs (3 and 4) will be linked only to the pipes of steaming the system.

What is claimed is:

1. A press for a pair of trousers, comprising:

a fixed panel having a top edge and a front edge;

a pair of mobile panels, said fixed panel being interposed between said mobile panels, said mobile panels being pivotally movable relative to said fixed panel;

a front slab slidably supported by said fixed panel and positioned at said top edge thereof;

a rear slab slidably supported by said fixed panel and positioned at said top edge thereof;

a scaffolding member positioned above said fixed panel;

a plurality of shaped members slidably supported by said scaffolding member;

a pair of fixed hooking members positioned above said front slab, said fixed hooking members being spatially separated;

a biased hooking member disposed intermediate to said two fixed hooking members, said biased hooking member being supported by a movable shaft biased in a rest position;

a retractable hooking member positioned above said rear slab and in substantial alignment with said biased hooking member and said retractable hooking member being movable, said fixed hooking members, said hooking member and said retractable hooking member being provided for cooperatively supporting an upper waist portion of said trousers;

a fork member movably disposed along said front edge of said fixed panel, said fork member having connecting mechanisms extending on two opposed faces of said fixed panel for engaging leg portions of said trousers;

means for producing steam and for feeding said steam to said fixed panel, said mobile panels, said front slab and said rear slab; and means for inhaling from said fixed panel and said mobile panels.

2. The press defined by claim 1, wherein:

at least one of said rear shaped members further includes an inflatable portion on an outside face thereof for spreading a waist portion of the trousers.

3. The press defined by claim 1, wherein:

each of said shaped members include a movable portion for engaging an inside portion of said trousers.

4. The press defined by claim 3, wherein:

said fixed panel includes a hollow member proximal to said top edge thereof, and said front slab includes a support member slidably received in a first end of said hollow member.

5. The press defined by claim 3, wherein:

at least two of said shaped members comprise front shaped members, said movable portions of each front shaped member being retractably movable relative thereto.

6. The press defined by claim 5, wherein:

said rear slab includes an upright member pivotally supported thereby and a support member, and said support member being slidably received in a second end of said hollow member.

7. The press defined by claim 6, further comprising:

moving means for moving said rear slab, said moving means moving said rear slab away from said second end of said hollow member until said upright member is pivoted due to engagement with said pair of trousers to a stopping position.

8. The press defined by claim 7, wherein:

said rear slab includes an upright member pivotally supported thereby and a support member, said support member being slidably received in a second end of said hollow member.

9. The press defined by claim 8 further comprising:

moving means for moving said rear slab, said moving means moving said rear slab away from said second end of said hollow member until said upright member is pivoted due to engagement with said pair of trousers to a stopping position.

10. The press defined by claim 5, wherein:

at least two of said shaped member comprise rear shaped members, said movable portions of each rear shaped member being pivotally movable relative thereto.

11. The press defined by claim 10, wherein:

at least one of said rear shaped members further includes an inflatable portion on an outside face thereof for spreading a waist portion of the trousers.

12. The press defined by claim 11, wherein:

said fixed panel includes a hollow member proximal to said top edge thereof, and said front slab includes a support member slidably received in a first end of said hollow member.

13. The press defined by claim 12, wherein:

said rear slab includes an upright member pivotally supported thereby and a support member, said support member being slidably received in a second end of said hollow member.

14. The press defined by claim 13, further comprising:

moving means for moving said rear slab, said moving means moving said rear slab away from said second end of said hollow member until said upright member is pivoted due to engagement with said pair of trousers to a stopping position.

* * * * *